US009206011B1

(12) United States Patent
Mallahan, III

(10) Patent No.: US 9,206,011 B1
(45) Date of Patent: Dec. 8, 2015

(54) TAPE CUTTING DEVICE

(71) Applicant: Lee Mallahan, III, Bossier City, LA (US)

(72) Inventor: Lee Mallahan, III, Bossier City, LA (US)

( * ) Notice: Subject to any disclaimer, the term of this patent is extended or adjusted under 35 U.S.C. 154(b) by 232 days.

(21) Appl. No.: 13/848,539

(22) Filed: Mar. 21, 2013

(51) Int. Cl.
*B65H 35/00* (2006.01)
*B26F 3/02* (2006.01)

(52) U.S. Cl.
CPC ..... *B65H 35/0026* (2013.01); *B26F 3/02* (2013.01); *Y10T 225/20* (2015.04); *Y10T 225/238* (2015.04)

(58) Field of Classification Search
CPC ..... B26F 3/00; B26F 3/02; B64H 35/002; B64H 35/04; B64H 35/0073; B64H 35/008; B64H 35/0026; Y10T 225/20; Y10T 225/238; Y10T 225/246; Y10T 225/247; Y10T 225/256; Y10T 225/257; Y10T 225/259; Y10T 225/26; Y10T 225/203; Y10T 225/225; Y10T 225/229; Y10T 156/1052; Y10T 156/12; Y10T 156/1365
USPC ..... 225/6, 9, 28, 31, 39, 46, 47, 55–58, 77
See application file for complete search history.

(56) References Cited

U.S. PATENT DOCUMENTS

| | | | | | |
|---|---|---|---|---|---|
| 2,655,214 | A * | 10/1953 | Cleef | 225/65 |
| 2,670,042 | A * | 2/1954 | Isler | 225/57 |
| 2,677,425 | A | 5/1954 | Broyles | |
| 2,717,641 | A * | 9/1955 | Wiederspan | 225/65 |
| 3,684,141 | A | 8/1972 | Hall | |
| 3,970,230 | A | 7/1976 | Horn | |
| 4,405,068 | A | 9/1983 | Blair | |
| 4,711,384 | A | 12/1987 | Harris | |
| 4,957,234 | A * | 9/1990 | Orlandini | 225/65 |
| 5,363,997 | A | 11/1994 | Harris | |
| 7,841,498 | B1 | 11/2010 | Rohrer | |
| 2006/0090843 | A1 * | 5/2006 | Steinhardt et al. | 156/247 |
| 2007/0295854 | A1 | 12/2007 | Thorp | |
| 2010/0084450 | A1 * | 4/2010 | Vulpitta | 225/47 |

* cited by examiner

*Primary Examiner* — Phong Nguyen
(74) *Attorney, Agent, or Firm* — R. Keith Harrison

(57) ABSTRACT

A tape cutting device includes a tape cutting unit adapted to ride along the tape roll, the tape cutting unit including a tape cutting blade having a tape cutting edge adapted to engage an outermost layer of the tape against the tape roll; and a retaining mechanism carried by the tape cutting unit, the retaining mechanism adapted to secure the tape cutting unit on the tape roll.

7 Claims, 11 Drawing Sheets

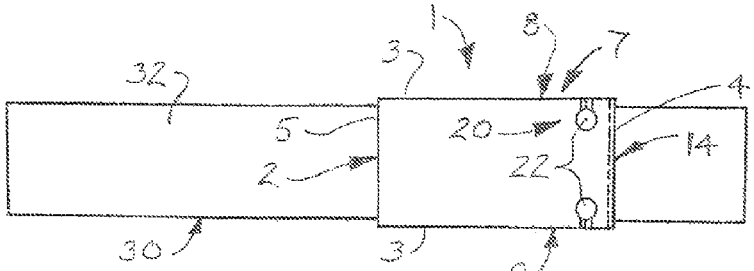
FIG. 8
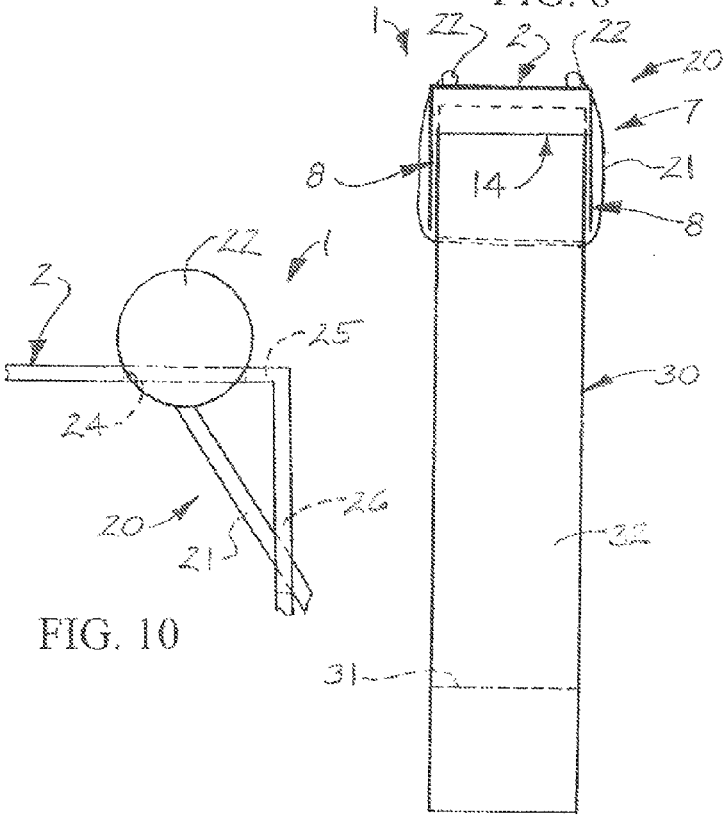
FIG. 9
FIG. 10
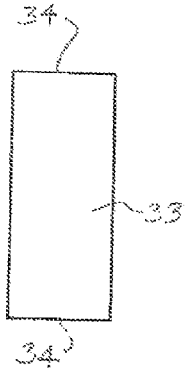
FIG. 11
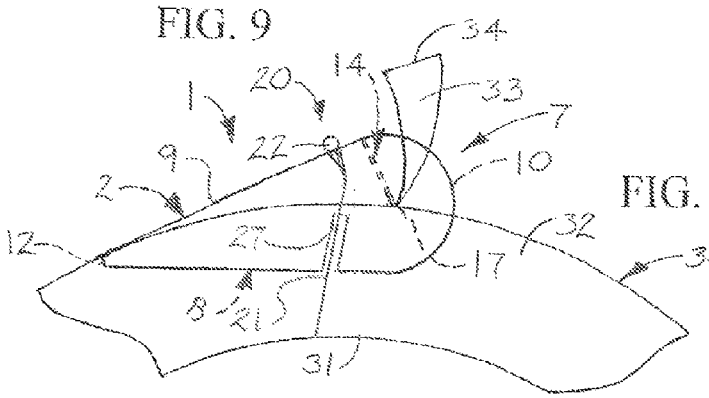
FIG. 12

TAPE CUTTING DEVICE

FIELD

Illustrative embodiments of the disclosure relate to devices for cutting adhesive tape. More particularly, illustrative embodiments of the disclosure relate to a roll-riding tape cutting device which can be used to cut tape segments of selected lengths and/or straight edges from adhesive tape wound on a tape roll.

BACKGROUND

Adhesive tape is commonly dispensed from a continuous tape roll having a cylindrical spool on which the tape is wound. In some applications, it may be desirable to obtain segments of tape having uniform lengths and/or straight edges. The tape segments are typically torn from the wound tape on the roll, however, with the result that the lengths and edges of the tape segments are often irregular, haphazard and non-uniform.

Accordingly, a roll-riding tape cutting device which can be used to cut tape segments of selected lengths and/or straight edges from adhesive tape wound on a tape roll may be desirable for some applications.

SUMMARY

Illustrative embodiments of the disclosure are generally directed to a tape cutting device for cutting tape segments from tape wound on a tape roll. An illustrative embodiment of the tape cutting device includes a tape cutting unit adapted to ride along the tape roll, the tape cutting unit including a tape cutting blade having a tape cutting edge adapted to engage an outermost layer of the tape against the tape roll; and a retaining mechanism carried by the tape cutting unit, the retaining mechanism adapted to secure the tape cutting unit on the tape roll.

BRIEF DESCRIPTION OF THE DRAWINGS

Illustrative embodiments of the disclosure will now be described, by way of example, with reference to the accompanying drawings, in which:

FIG. 8 is a top view of an illustrative tape cutting device, secured on a roll of tape in exemplary application of the tape cutting device;

FIG. 9 is a front view of an illustrative tape cutting device, secured on a roll of tape in exemplary application of the tape cutting device;

FIG. 10 is an enlarged sectional view, taken along section line 10 in FIG. 9, of it portion of an illustrative tape cutting device, more particularly illustrating a retainer bead of an exemplary retainer mechanism seated in a bead seat in the tape cutting unit according to an exemplary technique for securing the tape cutting device on a tape roll;

FIG. 11 is a top view of an exemplary tape segment cut from a roll of tape in implementation of an illustrative tape cutting device;

FIG. 12 is a side view of an illustrative tape cutting device, secured on a tape roll (partially in section) in exemplary implementation of the device, more particularly illustrating tearing of a segment of tape from the tape roll;

DETAILED DESCRIPTION

Figure 1:
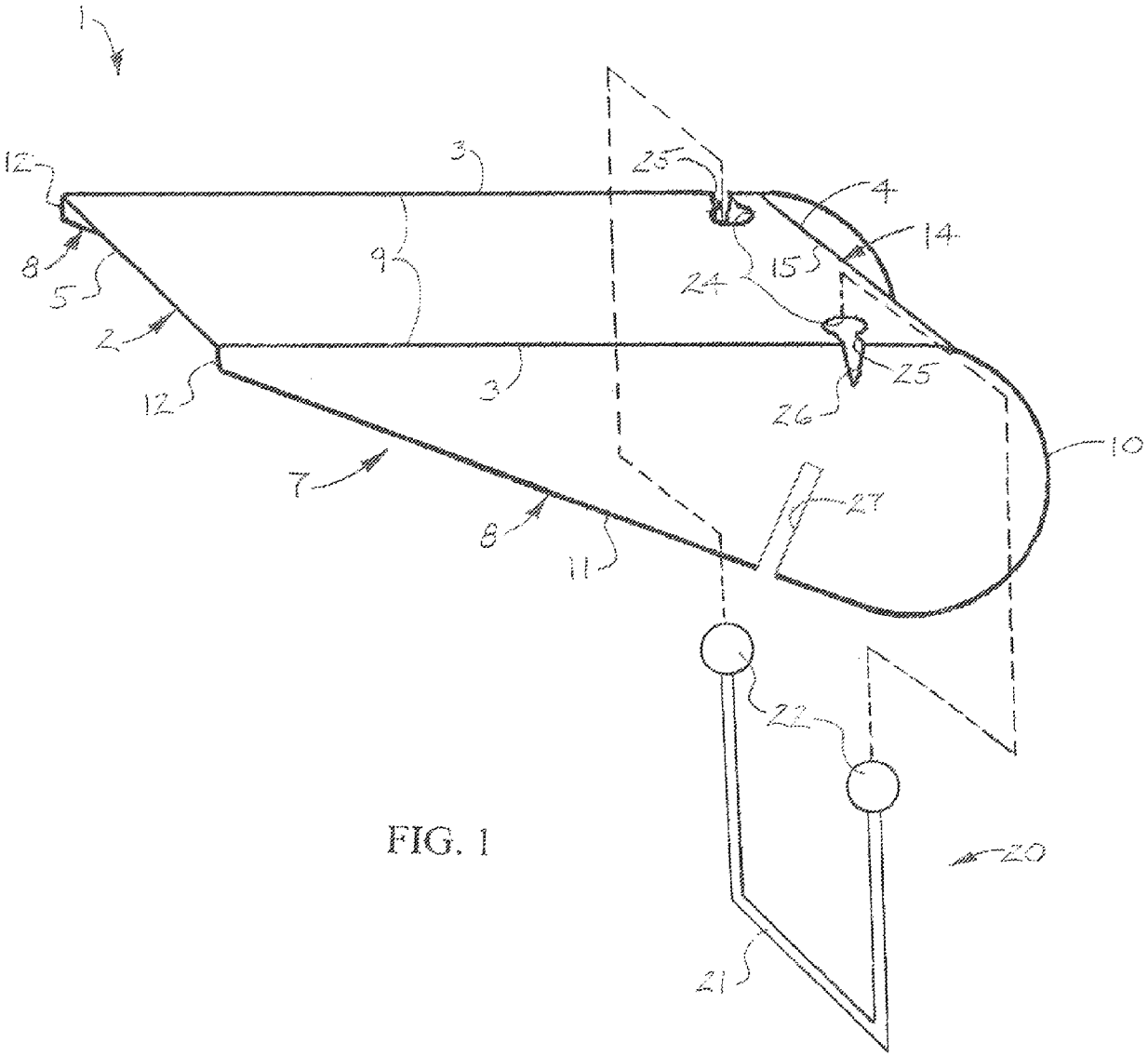
FIG. 1 is an exploded perspective view of an illustrative embodiment of the tape cutting device, with an exemplary tape cutting unit and an exemplary retainer mechanism which is suitable for securing the tape cutting unit on a roll of tape (not illustrated)
Figure 2:
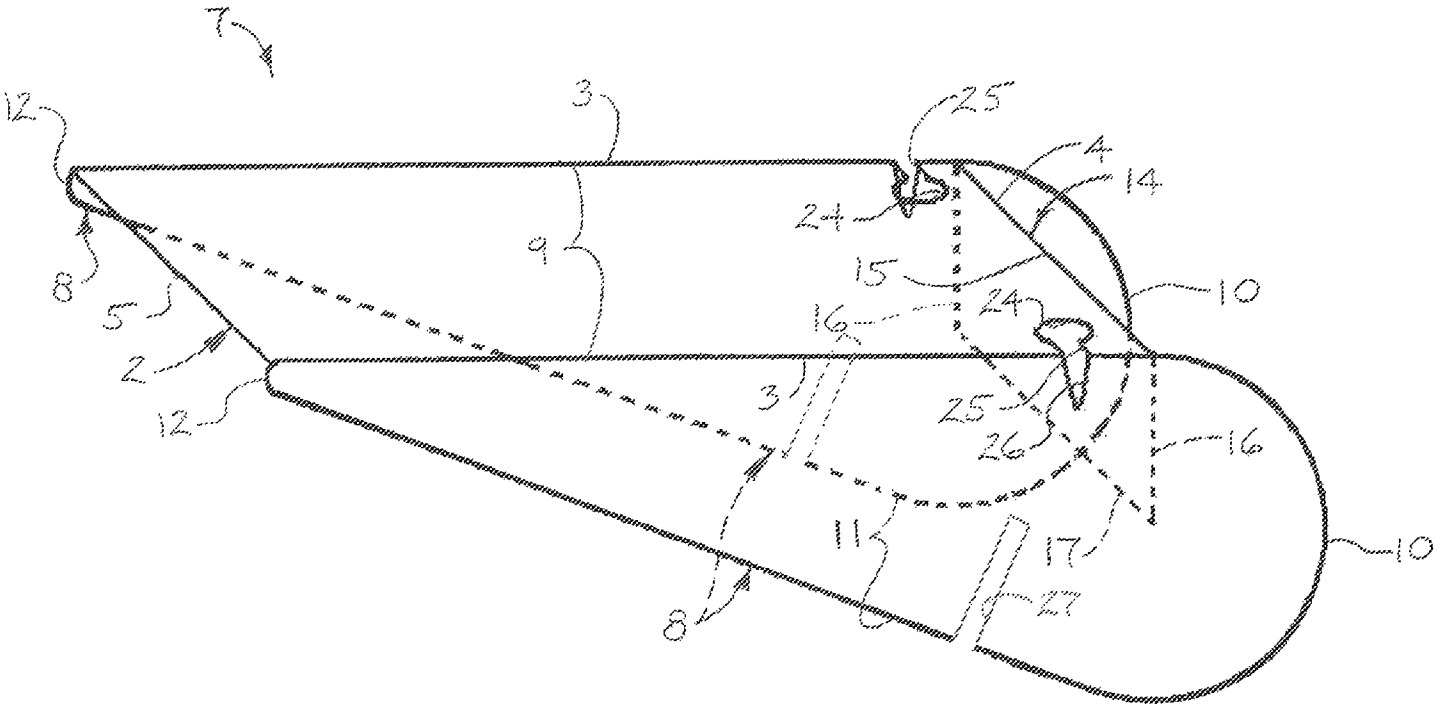
FIG. 2 is a perspective view of an exemplary tape cutting unit of a tape cutting device, with hidden components of the tape cutting unit illustrated in phantom lines.
Figure 3:
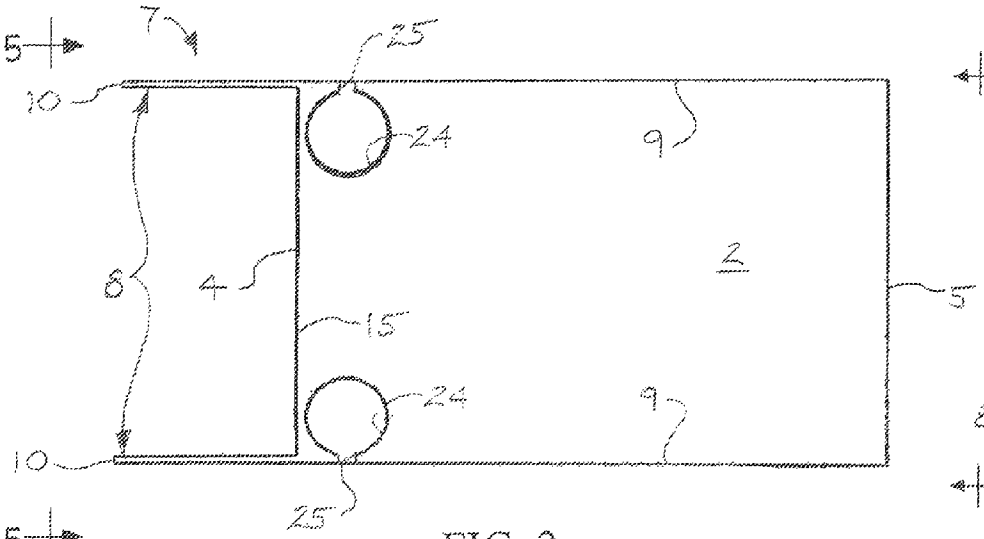
FIG. 3 is a top view of an exemplary tape cutting unit of a tape cutting device.
Figure 5:
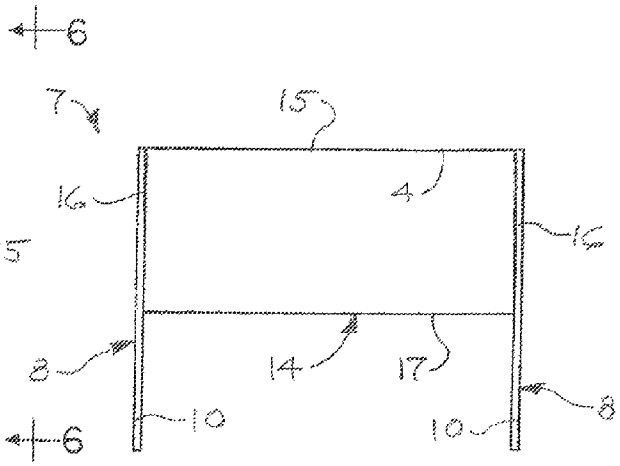
FIG. 5 is a front view, taken along section lines 5-5 in FIG. 3, of an exemplary tape cutting unit.
Figure 4:
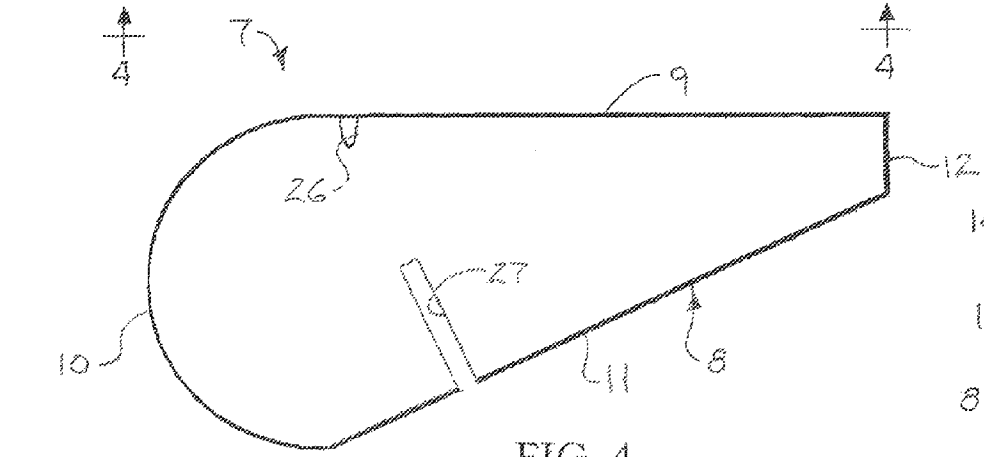
FIG. 4 is a side view, taken along side lines 4-4 in FIG. 3, of an exemplary tape cutting unit.
Figure 6:
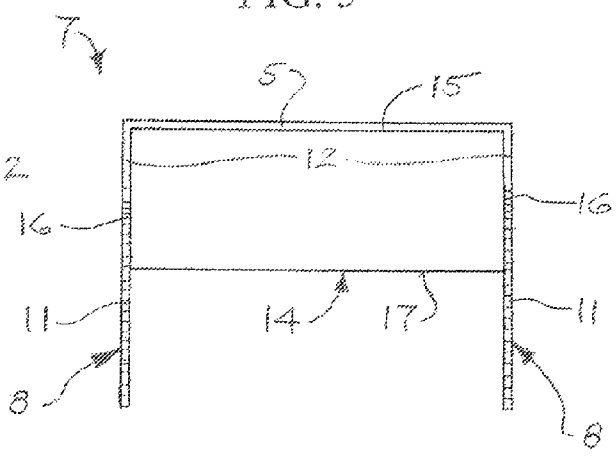
FIG. 6 is a rear view, taken along section lines 6-6 in FIG. 3, of an exemplary tape cutting unit.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "front" and "rear" as used herein are intended for descriptive purposes only and are not necessarily intended to be construed in a limiting sense.

Referring initially to FIGS. 1-16 of the drawings, an illustrative embodiment of the tape cutting device is generally indicated by reference numeral 1. As illustrated in FIGS. 8-16 and will be hereinafter described, the tape cutting device 1 is adapted to be secured on a tape roll 30 which may be conventional and typically has a spool 31 on which is wound a continuous length of adhesive tape 32. The adhesive tape 32 may be masking tape, duct tape, packaging tape or any other type of commercially-available adhesive tape which is wound on and dispensed from a spool 31 for any of a variety of purposes. The tape cutting device 1 can be used to cut tape segments 33 (FIG. 11) of consistently selected uniform lengths and/or straight edges 34 from the tape 32 wound on the spool 31.

As illustrated in FIGS. 1-7, the tape cutting device 1 includes a tape cutting unit 7 and a retainer mechanism 20 which secures the tape cutting unit 7 on the tape roll 30. The tape cutting unit 7 may include a device panel 2. The device panel 2 may be generally rectangular with a pair of spaced-apart, parallel side panel edges 3 and a blade support edge 4 and a tape roll engaging edge 5 extending between the side panel edges 3 in parallel, spaced-apart relationship to each other.

A pair of spaced-apart tape roll guides 8 may extend from the respective side panel edges 3 of the device panel 2. The tape roll guides 8 may be disposed at a generally 90-degree angle with respect to the device panel 2 and in generally parallel spaced-apart relationship to each other. Each tape roll guide 8 may have a straight panel attachment edge 9 which is joined to or continuous with the corresponding side panel edge 3 of the device panel 2. Each tape roll guide 8 may have a blade end guide edge 10 which may be generally semicircular and is continuous with the panel attachment edge 9 and protrudes beyond the blade support edge 4 of the device panel 2. A return guide edge 11 may be straight and is continuous with the blade end guide edge 10. A terminal guide edge 12 may be continuous with the return guide edge 11 and the panel attachment edge 9 at the tape roll engaging edge 5 of the device panel 2.

A tape cutting blade 14 extends from the blade support edge 4 of the device panel 2 and is disposed between the spaced-apart tape roll guides 8. The tape cutting blade 14 may be disposed at a generally 90-degree angle with respect to the device panel 2 and with respect to each of the tape roll guides 8. As particularly illustrated in FIGS. 2 and 5, the tape cutting blade 14 may be generally rectangular with a blade attachment edge 15 which is joined to or continuous with the blade support edge 4 of the device, panel 2; a pair of spaced-apart, parallel blade side edges 16 which extend from the blade attachment edge 15 and may be engaged by the respective tape roll guides 8; and a tape cutting edge 17 which extends between the blade side edges 16 in spaced-apart, parallel relationship to the blade attachment edge 15. The tape cutting edge 17 may be tapered in cross-section.

Figure 7:
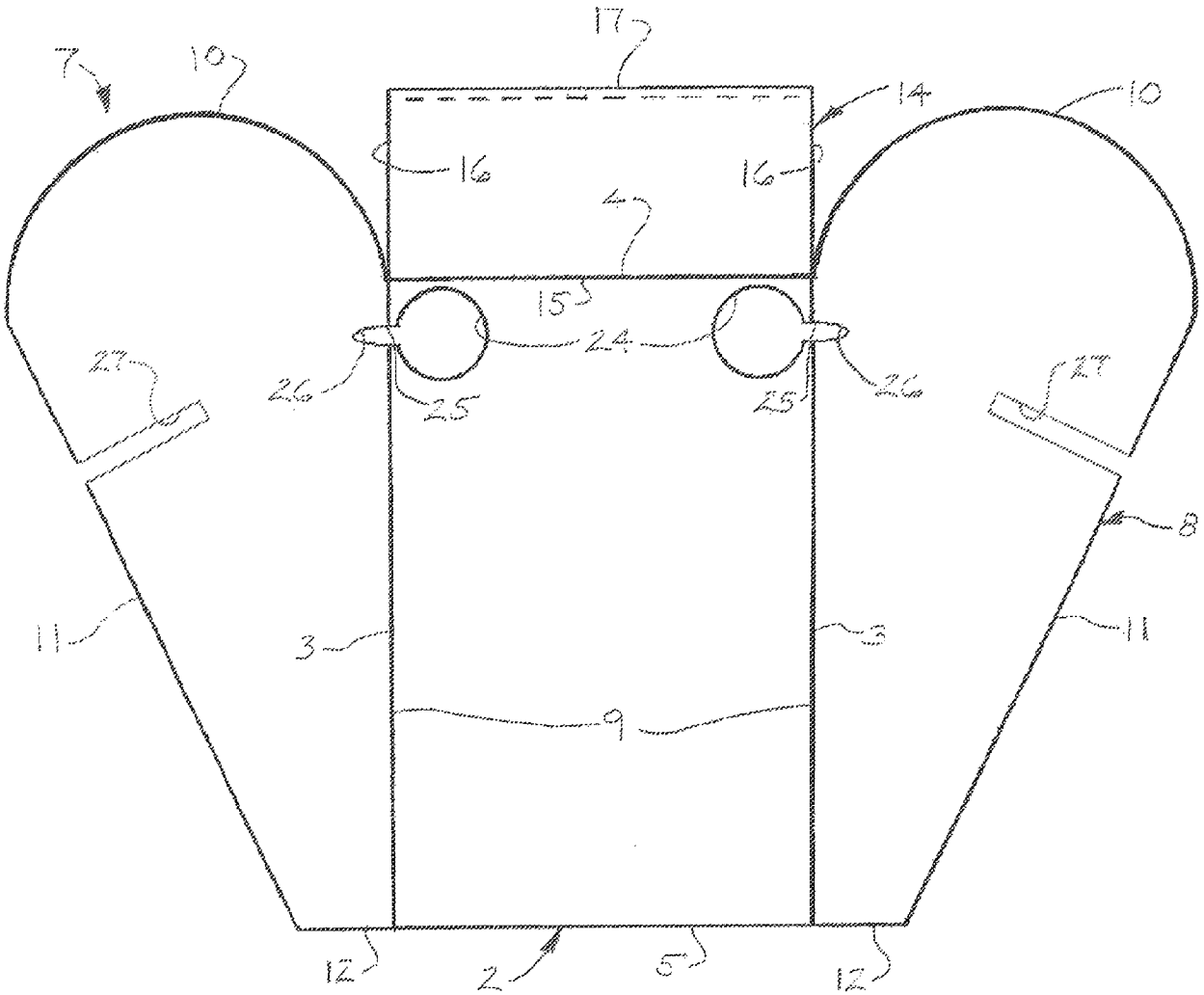
FIG. 7 is a top view of an exemplary unfolded tape cutting unit according to an illustrative embodiment of the tape cutting device.

The tape cutting unit 7 may be any material which is consistent with the functional requirements of the tape cutting device 1. Non-limiting examples of materials which are suitable for the purpose include aluminum, steel, high-grade plastics, composite materials and combinations thereof. The tape cutting unit 7 can be fabricated using any of a variety of fabrication techniques known by those skilled in the art including but not limited to casting, molding, machining, welding and soldering. As illustrated in FIG. 7, in some methods of fabrication, the device panel 2, the tape roll guides 8 and the tape cutting blade 14 of the tape cutting unit 7 may be cut or stamped flat front a sheet (not illustrated) of material such as aluminum, steel or composite material, for example and without limitation. The tape roll guides 8 may be folded along the respective side panel edges 3 and the tape cutting blade 14 may be folded along the blade support edge 4 of the device panel 2 to shape the tape cutting unit 7. In other methods of fabrication, the tape roll guides 8 and the tape cutting blade 14 may be fabricated separately and attached to the device panel 2 according to the knowledge of those skilled in the art.

Figure 13:
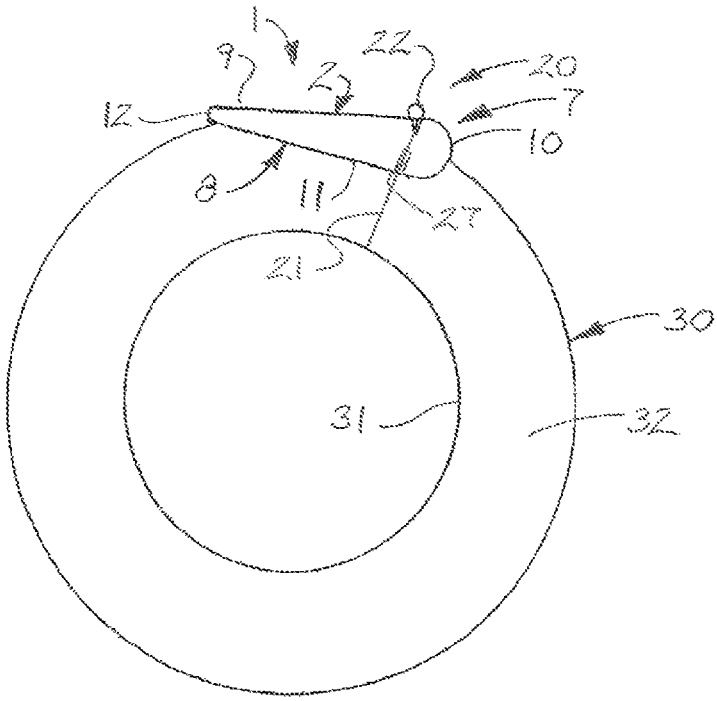
FIG. 13 is a side view of an illustrative tape cutting device, secured on a tape roll in exemplary implementation of the device.

As further illustrated in FIG. 1, the tape cutting device 1 may include a retainer mechanism 20 which secures the tape cutting unit 7 on the tape roll 30 (FIG. 13). In some embodiments, the retainer mechanism 20 may include an elongated, flexible and elastic retainer cord 21. Retainer members 22 may terminate the opposite ends of the retainer cord 21. The retainer members 22 may be beads, knots, washers or the like. A pair of spaced-apart retainer seats 24 may be provided in the device panel 2 of the tape cutting unit 7. A cord slit 25 communicates with and extends from each retainer seat 24 to the side panel edge 3 of the device panel 2. A cord notch 26 in the tape roll guide 8 communicates with the cord slit 25. A cord accommodation notch 27 may extend from the return guide edge 11 of each tape roll guide 8, at an angle toward the retainer seat 24. Accordingly, as illustrated in FIGS. 8-10, the retainer members 22 are seated and retained in the respective retainer seats 24 in the device panel 2. The retainer cord 21 extends through the cord notches 26 in the respective tape roll guides 8 and adjacent to the respective cord accommodation slots 27 through the spool 31 of the tape roll 30, engaging the inner surface of the spool 31. Thus, the retainer cord 21 of the retainer mechanism 20 maintains a secure and tight fit of the tape cutting unit 7 on the tape roll 30 throughout use of the tape cutting device 1, as will be hereinafter described.

As illustrated in FIGS. 8-16, in exemplary application of the tape cutting device 1, the tape cutting unit 7 is secured on the tape roll 30 by initially placing the spaced-apart tape roll guides 8 on opposite sides of the tape roll 30. The tape roll engaging edge 5 of the device panel 2 engages the outermost layer of the tape 32 which is wound on the spool 31 of the tape roll 30. The tape cutting edge 17 on the tape cutting blade 14 engages the outermost layer of tape 32 against the underlying layers of tape 32 on the tape roll 30. The retainer mechanism 20 secures the tape cutting unit 7 on the tape roll 30 by extension of the retainer cord 21 through the cord notches 26 and the spoof 31 and seating of the retainer members 22 in the respective retainer seats 24 in the device panel 2.

The tape cutting unit 7 is slid along the tape roll 30 until the tape cutting blade 14 is located at a selected distance from the free end (not illustrated) of the tape 32, which distance corresponds to the desired length of the tape segment 33 to be cut from the tape 32. Manual pressure may be applied to the device panel 2 such that the tape cutting edge 17 of the tape cutting blade 14 crimps the tape 32. The free end of the tape 32 is next located and grasped, and the tape segment 33 which is to be removed is peeled from the underlying portion of the tape 32 wound on the spool 31. As it is removed from the underlying wound tape 32, the tape segment 33 is pulled against and across the tape cutting edge 17 of the tape cutting blade 14 such that the blade attachment edge 15 severs the tape segment 33 from the tape 32. As illustrated in FIG. 11, it will be appreciated by those skilled in the art that the blade attachment edge 15 of the tape cutting blade 14 cuts a straight edge 34 in the tape segment 33 as well as multiple tape segments 33 of selected and uniform or consistent length.

Figure 14:
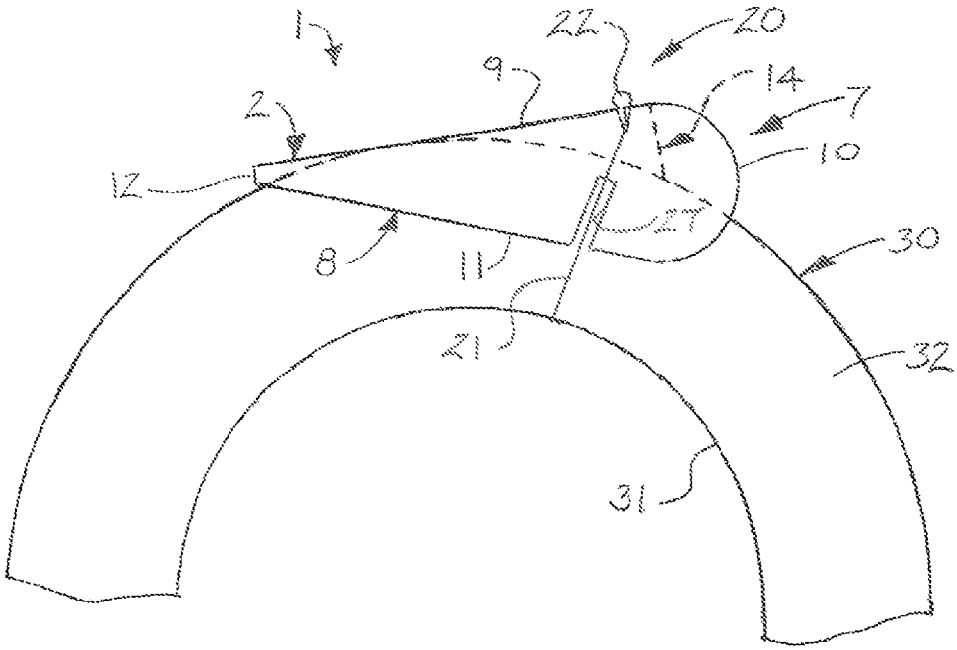
FIGS. 14-16 are side views of an illustrative tape cutting device secured on a tape roll partially in section) in exemplary implementation of the device, with the retainer mechanism maintaining a tight fit of the device on the tape roll of decreasing diameter as the tape segments are progressively dispensed from the roll.
Figure 15:
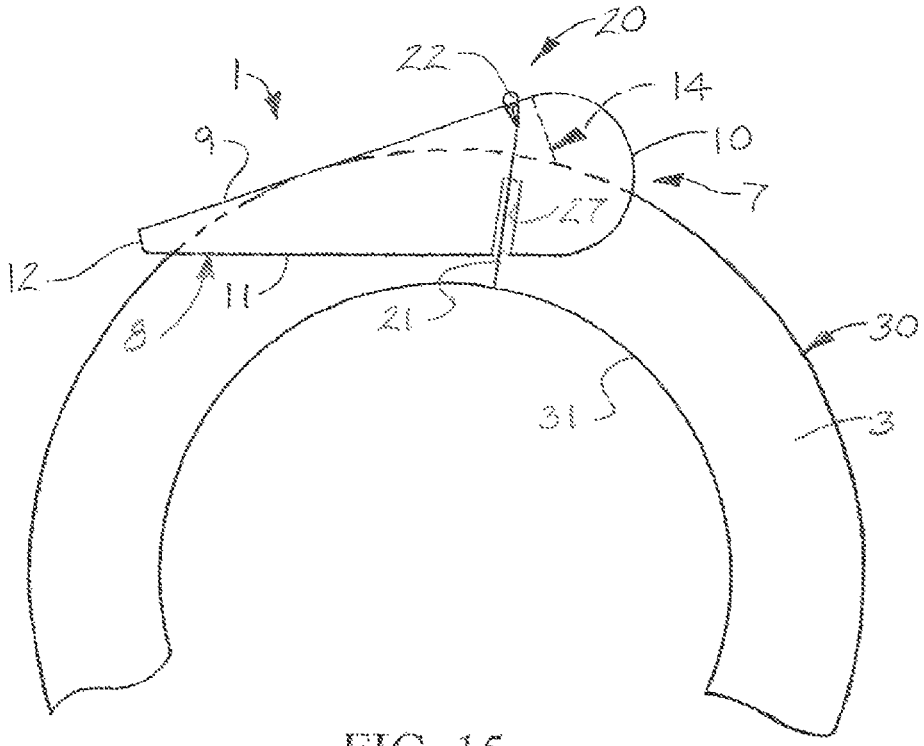
Figure 16:
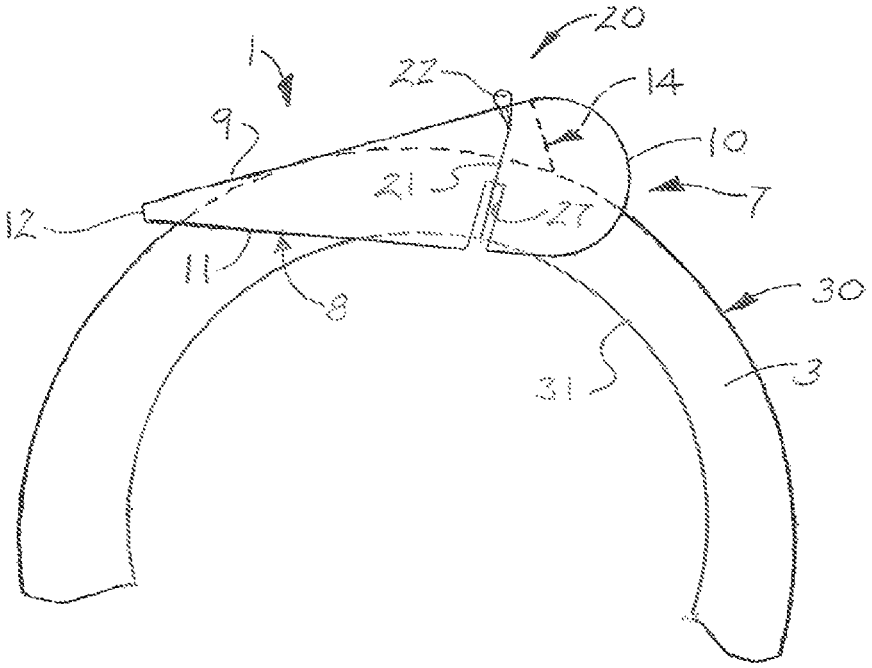

As the tape segments 33 are cut and dispensed from the tape roll 30, the tape cutting device 1 is pushed or "rides" along the tape roll 30 to position the tape cutting edge 17 of the tape cutting blade 14 at the selected positions along the tape 32 for cutting and dispensing of the tape segments 33 of selected length. Throughout use of the tape cutting device 1, the elastic retainer cord 21 of the retainer mechanism 20 is constantly in a contracted state and thus, continually maintains a secure and snug fit of the tape cutting unit 7 against the tape roll 30. Therefore, as the diameter of the tape roll 30 progressively decreases as a result of the tape 32 being gradually dispensed from the spool 31, as illustrated in FIGS. 14-16, the retainer cord 21 contracts and continues to snugly secure the tape cutting unit 7 on the tape roll 30 and prevents loosening of the tape cutting unit 7. As illustrated in FIG. 16, when the diameter of the tape roll 30 decreases to the point at which the spool 31 of the tape roll 30 recedes beyond the return guide edge 11 of each tape roll guide 8, the cord accommodation slots 27 accommodate the retainer cord 21 such that the retainer cord 21 continues to engage the inner surface of the spool 31. When all of the tape 32 has been dispensed from the spool 31, the tape cutting unit 7 can he removed from the spool 31 by disengaging the retainer members 22 from the respective retainer seats 24 in the device panel 2 and removing the retainer cord 21. The tape cutting device 1 can be subsequently used in a similar manner on a fresh tape roll 30.

Figure 17:
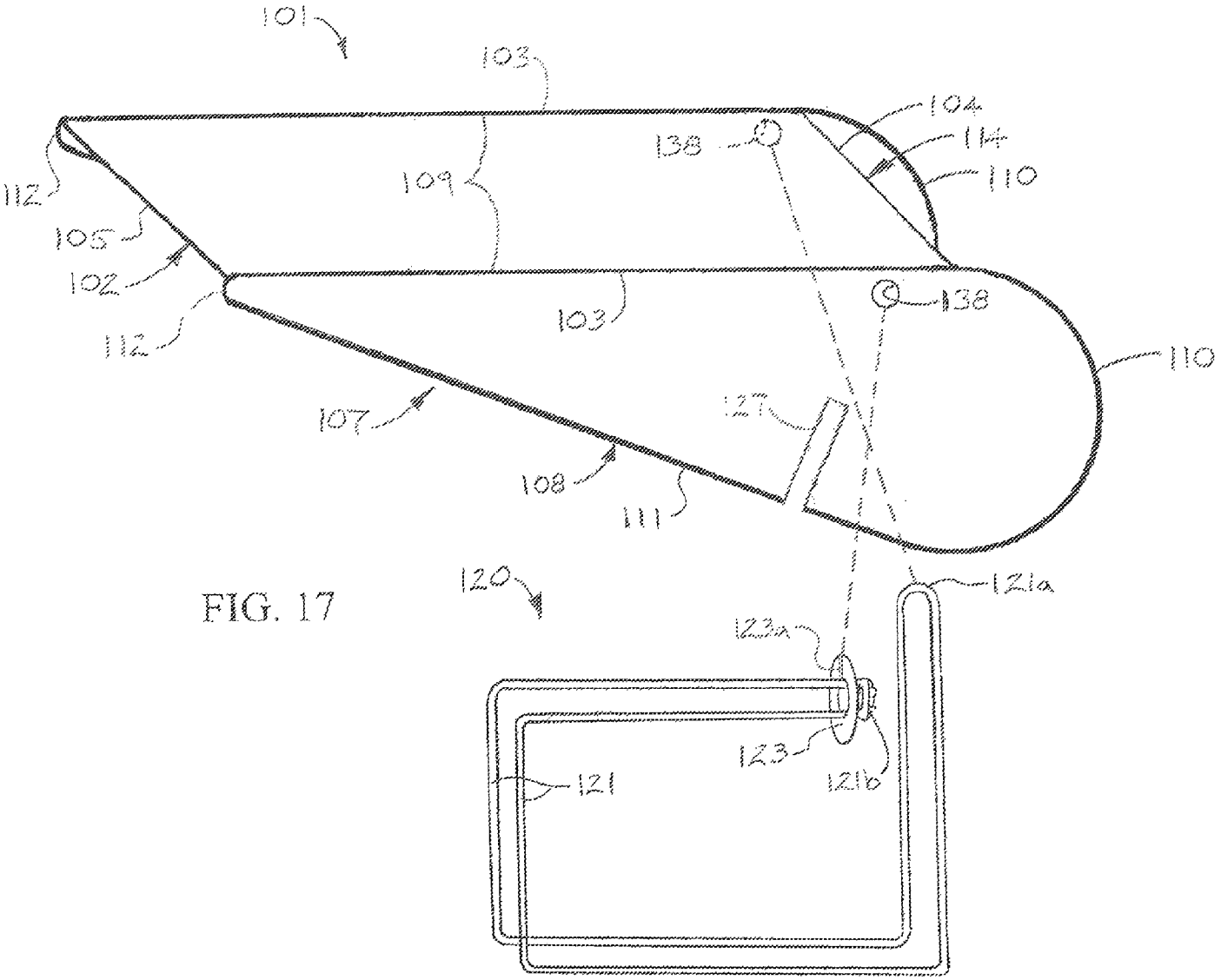
FIG. 17 is an exploded perspective view of an illustrative tape cutting device, with an alternative exemplary retainer mechanism which is suitable for securing the tape cutting unit of the tape cutting device on a roll of tape.
Figure 17A:
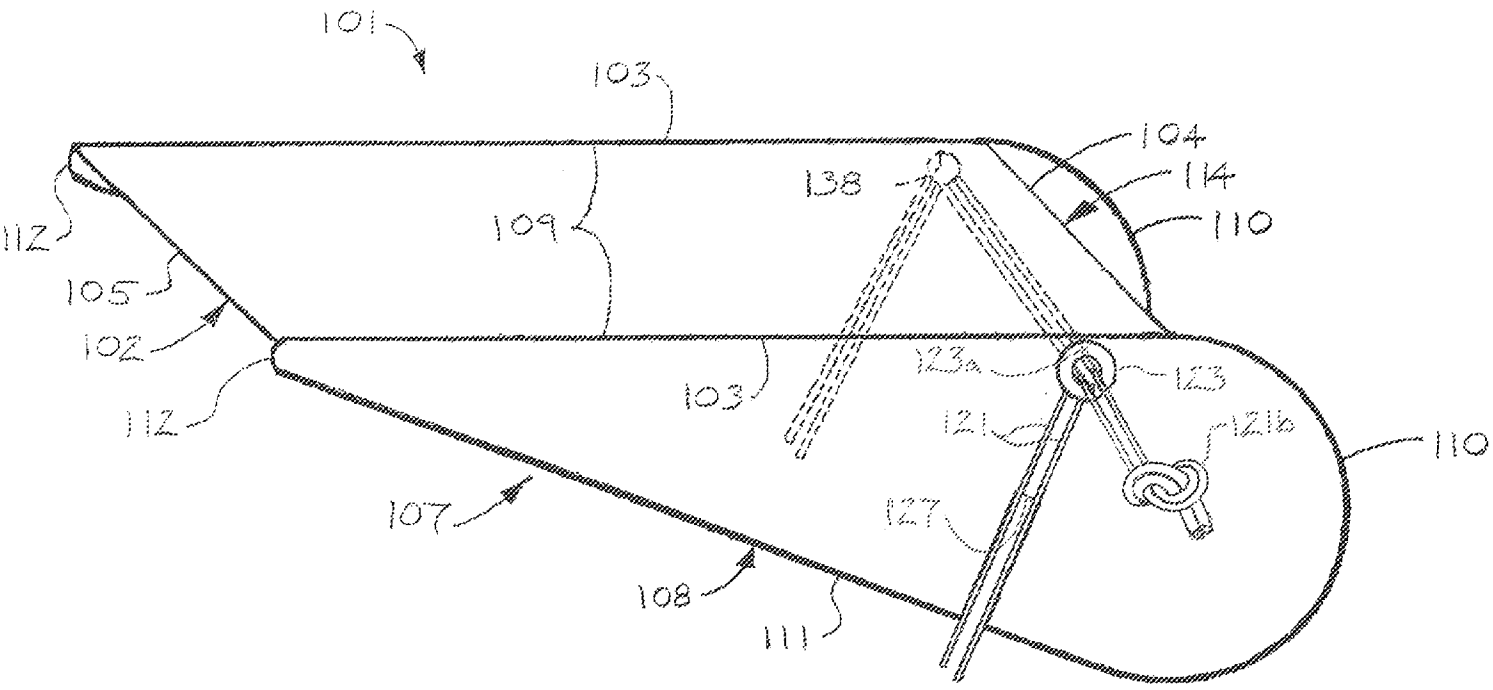
FIG. 17A is a perspective view of an illustrative tape cutting device with the exemplary retainer mechanism illustrated in FIG. 17.

Referring next to FIGS. 17 and 17A of the drawings, an alternative illustrative embodiment of the tape cutting device is generally indicated by reference numeral 101. In the tape cutting device 101 of FIG. 17, elements which are analogous to the respective elements of the tape cutting device 1 that was heretofore described with respect to FIGS. 1-16 are designated by the same numeral in the 101-199 series. An exemplary retainer mechanism 120 may include an elastic retainer cord 121 having a cord loop 121*a*. A cord knot 121*b* may be tied in the ends of the retainer cord 121 and retains a retainer washer 123 on the retainer cord 121. The washer 123 may have a washer slot 123*a*. A pair of spaced-apart cord openings 138 may extend through the respective tape roll guides 108. Accordingly, the retainer cord 121 is extended through the cord openings 138 and through the spool 31 (FIG. 13) of the tape roll 30. The cord loop 121*a* receives and engages the retainer washer 123, which retains the retainer cord 121 around the tape roll 30 such that the tape cutting unit 7 is retained on the spool 31. The retainer cord 121 may be pulled through the retainer washer 123 by grasping the cord knot 121*b* to tighten the retainer cord 121 as the tape roll 30 decreases in diameter during the course of use. Application of the tape cutting device 101 may be as was heretofore described with respect to the tape cutting device 1 in FIGS. 1-16.

Figure 18:
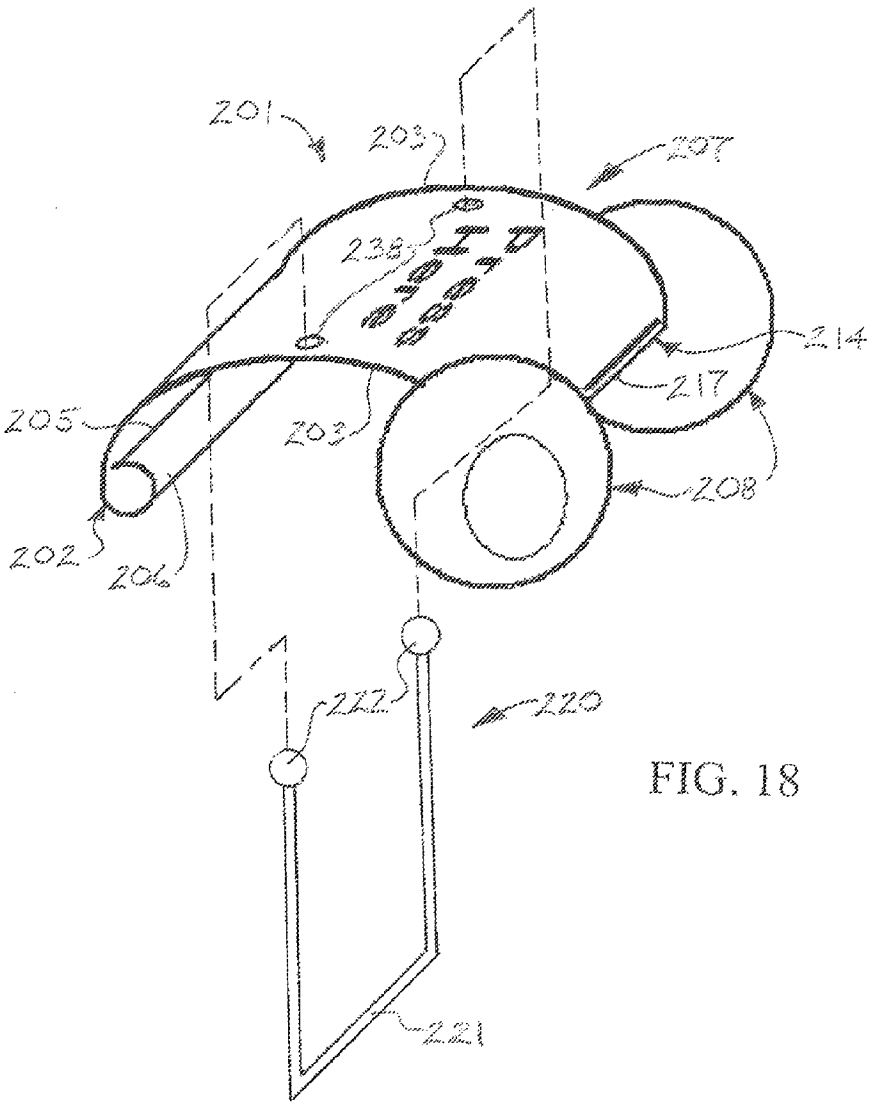
FIG. 18 is an exploded perspective view of an alternative illustrative embodiment of the tape cutting device.

Referring next to FIG. 18 of the drawings, another alternative illustrative embodiment of the tape cutting device is generally indicated by reference numeral 201. In the tape cutting device 201 of FIG. 18, elements which are analogous to the respective elements of the structure 1 that was heretofore described with respect to FIGS. 1-16 are designated by the same numeral in the 201-299 series. The device panel 202 of the tape cutting unit 207 may be generally curved with a tape roll engaging roll 206 at the tape wall engaging edge 205. A pair of spaced-apart circular tape roll guides 208, each of which may be circular, may be provided on the respective side panel edges 203 of the device panel 202. A tape cutting blade 214 has to tape cutting edge 217 which corresponds to a front edge of the device panel 202 and extends between the tape roll guides 208.

A retainer mechanism 220 is adapted to secure the tape cutting unit 207 on a tape roll 30 (FIGS. 8-16). In some embodiments, the retainer mechanism 220 may include an elastic retainer cord 221 terminated by a pair of retainer members 222. A pair of spaced-apart cord openings 238 may be provided in the device panel 202. Accordingly, the retainer members 222 are seated and retained in the respective cord openings 238 in the device panel 202. The retainer cord 221 extends through the cord openings 238 in the device panel 202 and through the spool 31 of the tape roll 30, engaging the inner surface of the spool 31. In other embodiments, the retainer mechanism 220 may have alternative designs which are suitable for the purpose of securing the tape cutting unit 207 on the tape roll 30. The tape roll engaging roll 206 of the device panel 202 engages the tape roll 30, and the tape roll guides 208 are positioned on opposite sides of the tape roll 30. Application of the tape cutting device 101 may be as was heretofore described with respect to the tape cutting device 1 in FIGS. 8-16. The retainer cord 221 of the retainer mechanism 220 maintains a secure and tight fit of the tape cutting unit 207 on the tape roll 30 throughout use of the tape cutting device 201, as was heretofore described with respect to the tape cutting device 1.

Figure 19:
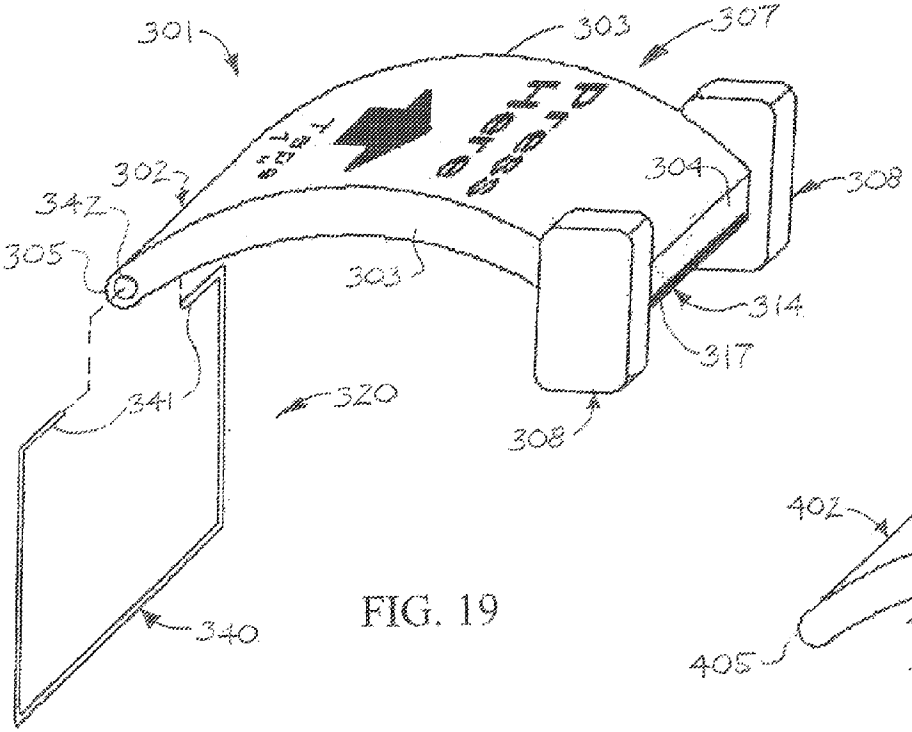
FIG. 19 is an exploded perspective view of another illustrative embodiment of the tape cutting device.

Referring next to FIG. 19 of the drawings, another alternative illustrative embodiment of the tape cutting device is generally indicated by reference numeral 301. In the tape cutting device 301 of FIG. 19, elements which are analogous to the respective elements of the tape cutting device 1 that was heretofore described with respect to FIGS. 1-16 are designated by the same numeral in the 301-399 series. The device panel 302 of the tape cutting device 301 may be generally curved. A pair of spaced-apart, block-shaped tape roll guides 308 may be provided on the respective side panel edges 303 of the device panel 302. A tape cutting blade 314 has a tape cutting edge 317 which corresponds to a front edge of the device panel 302 and extends between the tape roll guides 308.

An exemplary retainer mechanism 320 of the tape cutting device 301 may include a retainer wire 340 having a pair of spaced-apart and inwardly-facing insertion ends 341. A pair of retainer wire openings 342 may be provided in the respective side panel edges 303 of the device panel 302. The retainer wire openings 342 are adapted to receive the respective insertion ends 341 of the retainer wire 340. Accordingly, the tape cutting unit 307 is secured on a tape roll 30 (FIGS. 8-16) by initially extending the retainer wire 340 through the spool 31 of the tape roll 30 and then inserting the insertion ends 341 of the retainer wire 340 into the respective retainer wire openings 342. The tape roll engaging edge 305 of the device panel 302 engages the tape roll 30, and the tape roll guides 308 are positioned on opposite sides of the tape roll 30. The retainer wire 340 of the retainer mechanism 320 maintains a secure and tight fit of the tape cutting unit 307 on the tape roll 30 throughout use of the tape cutting device 301, as was heretofore described with respect to the tape cutting device 1. In other embodiments, the retainer mechanism 320 may have alternative designs which are suitable for the purpose of securing the tape cutting unit 307 on the tape roll 30.

Figure 20:
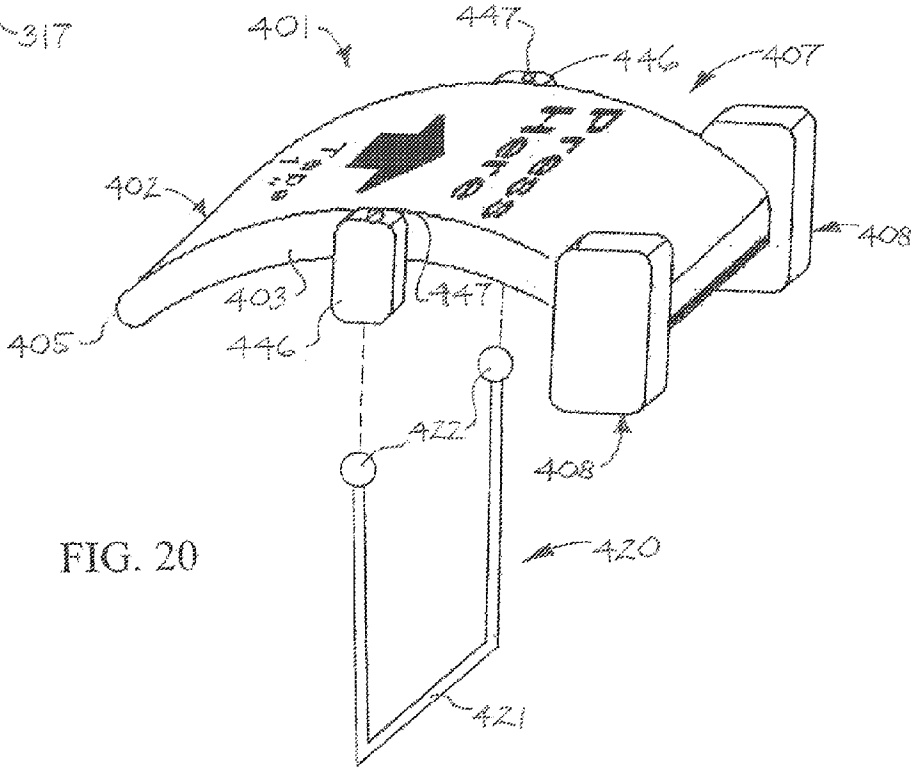
FIG. 20 is an exploded perspective view of still another illustrative embodiment of the tape cutting device.

Referring next to FIG. 20 of the drawings, another alternative illustrative embodiment of the tape cutting device is generally indicated by reference numeral 401. In the tape cutting device 401 of FIG. 20, elements which are analogous to the respective elements of the tape cutting device 301 that was heretofore described with respect to FIG. 19 are designated by the same numeral in the 401-499 series. An exemplary retainer mechanism 420 which secures the tape cutting unit 407 to a tape roll 30 may include a pair of spaced-apart retainer mount members 446. A cord opening 447 may extend through each retainer mount member 446. A retainer cord 421 which terminates in a pair of retainer members 422 extends through and is retained in each cord opening 447 as the retainer members 422 seat on the respective retainer mount members 446. The retainer cord 421 extends through the spool 31 of the tape roll 30, engaging the inner surface of the spool 31. In other embodiments, the retainer mechanism 420 may have alternative designs which are suitable for the purpose of securing the tape cutting unit 407 on the tape roll 30. the tape roll engaging edge 405 of the device panel 402 engages the tape roll 30, and the tape roll guides 408 are positioned on opposite sides of the tape roll 30. Application of the tape cutting device 401 may be as was heretofore described with respect to the tape cutting device 1 in FIGS. 8-16. The retainer cord 421 of the retainer mechanism 420 maintains a secure and tight fit of the tape cutting unit 407 on the tape roll 30 throughout use of the tape cutting device 401, as was heretofore described with respect to the tape cutting device 1.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A tape cutting device for cutting tape segments from tape wound on a tape roll, comprising:

a tape cutting unit adapted to ride along the tape roll, the tape cutting unit including a generally rectangular device panel having a pair of side panel edges and a blade support edge and a tape roll engaging edge extending between the side panel edges; a pair of spaced-apart tape roll guides carried by the device panel; and a tape cutting blade carried by the blade support edge and having a tape cutting edge adapted to engage an outermost layer of the tape against the tape roll; and a retaining mechanism carried by the tape cutting unit, the retaining mechanism adapted to secure the tape cutting unit on the tape roll and wherein the retaining mechanism comprises a pair of retainer seats in the device panel; a pair of cord slits in the device panel and communicating with the retainer seats, respectively; a pair of cord notches in the tape roll guides and communicating with the cord slits, respectively; and an elastic retainer cord and a pair of retainer members carried by the retainer cord and seated in the retainer seats, respectively, the retainer cord extending through the cord slits and the cord notches and adapted to engage the tape roll.

2. A tape cutting device for cutting tape segments from tape wound on a tape roll, comprising:

a tape cutting unit adapted to ride along the tape roll, the tape cutting unit including:

a device panel;

a pair of spaced-apart tape roll guides carried by the device panel, the tape roll guides adapted for positioning on opposite sides of the tape roll; and a tape cutting blade carried by the device panel between the tape roll guides, the tape cutting blade having a tape cutting edge adapted to engage an outermost layer of the tape against the tape roll; and a retaining mechanism carried by the tape cutting unit, the retaining mechanism adapted to secure the tape cutting unit on the tape roll and including a pair of retainer seats in the device panel; a pair of cord slits in the device panel and communicating with the retainer seats, respectively; a pair of cord notches in the tape roll guides and communicating with the cord slits, respectively; and an elastic retainer cord and a pair of retainer members carried by the retainer cord and seated in the retainer seats, respectively, the retainer cord extending through the cord slits and the cord notches and adapted to engage the tape roll.

3. The tape cutting device of claim 2 wherein the retaining mechanism comprises a pair of cord accommodation slots in the tape cutting unit.

4. The tape cutting device of claim 3 wherein the pair of retainer members comprises a pair of retainer beads.

5. The tape cutting device of claim 2 wherein the device panel is generally rectangular and comprises a pair of side panel edges and a blade support edge and a tape roll engaging edge extending between the side panel edges, and wherein the tape cutting blade is carried by the blade support edge.

6. A tape cutting device for cutting tape segments from tape wound on a tape roll, comprising:

a tape cutting unit adapted to ride along the tape roll, the tape cutting unit including:

a generally rectangular device panel having a pair of spaced-apart, parallel side edges and a blade support edge and a tape roll engaging edge extending between the side edges in spaced-apart, parallel relationship to each other;

a pair of spaced-apart tape roll guides carried by the side edges, respectively, of the device panel, the tape roll guides disposed at a generally 90-degree angle to the device panel and adapted for positioning on opposite sides of the tape roll; and a tape cutting blade carried by the blade support edge of the device panel and extending between the tape roll guides, the tape cutting blade disposed at a generally 90-degree angle to the device panel and having a tape cutting edge adapted to engage an outermost layer of the tape against the tape roll; and a retaining mechanism carried by the tape cutting unit, the retaining mechanism adapted to secure the tape cutting unit on the tape roll and including a pair of retainer seats in the device panel; a pair of cord slits in the device panel and communicating with the retainer seats, respectively; a pair of cord notches in the tape roll guides and communicating with the cord slits, respectively; and an elastic retainer cord and a pair of retainer members carried by the retainer cord and seated in the retainer seats, respectively, the retainer cord extending through the cord slits and the cord notches and adapted to engage the tape roll.

7. The tape cutting device of claim 6 wherein the pair of retainer members comprises a pair of retainer beads.

* * * * *